US006490819B1

(12) United States Patent
Kumata et al.

(10) Patent No.: US 6,490,819 B1
(45) Date of Patent: Dec. 10, 2002

(54) DECORATIVE SHEET

(75) Inventors: Masataka Kumata, Wako (JP); Naoto Ishii, Wako (JP); Hidehito Fukumoto, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 191 days.

(21) Appl. No.: 09/721,982

(22) Filed: Nov. 27, 2000

(30) Foreign Application Priority Data

Nov. 25, 1999 (JP) ..... 11-334103

(51) Int. Cl.[7] ..... G09F 19/00

(52) U.S. Cl. ..... 40/615; 40/582; 40/583; 40/208

(58) Field of Search ..... 40/615, 582, 583, 40/208

(56) References Cited

U.S. PATENT DOCUMENTS

| | | | | |
|---|---|---|---|---|
| 1,947,549 | A | * | 2/1934 | Fuchs |
| 1,959,090 | A | * | 5/1934 | Wood |
| 3,402,495 | A | * | 9/1968 | Fishback |
| 3,405,025 | A | * | 10/1968 | Goldman |
| 3,453,761 | A | * | 7/1969 | Giesecke |
| 5,389,413 | A | * | 2/1995 | Condon et al. ..... 40/615 |
| 5,809,681 | A | * | 9/1998 | Miyamoto et al. ..... 40/582 |
| RE37,186 | E | * | 5/2001 | Hill ..... 40/584 |

FOREIGN PATENT DOCUMENTS

| | | | | |
|---|---|---|---|---|
| EP | 0531939 A1 | * | 3/1993 | |
| JP | 06182937 A | | 7/1994 | |
| JP | 06324631 A | * | 11/1994 | ..... 40/582 |
| WO | WO 93/07605 | * | 4/1993 | |

* cited by examiner

*Primary Examiner*—D. Glenn Dayoan
*Assistant Examiner*—Lori L Coletta
(74) *Attorney, Agent, or Firm*—Arent Fox Kintner Plotkin & Kahn, PLLC

(57) ABSTRACT

A decorative sheet including a pattern with a third-dimensional appearance is provided. The decorative sheet has a reflective layer for reflecting incident light. On the reflective layer, a transparent layer is formed. On the transparent layer, a light shielding layer for shielding incident light is formed. A pattern layer is interposed between the light shielding layer and the reflective layer in such a manner, for example, that it is included in the rear surface of the light shielding layer or in the transparent layer. The light shielding layer is provided with a plurality of through holes for passing incident light toward the reflective layer and emission light which leads out a pattern image reflected in the reflective layer.

8 Claims, 10 Drawing Sheets

DECORATIVE SHEET

BACKGROUND OF THE INVENTION

1. Field of the Invention

The present invention relates to a decorative sheet designed to give a three-dimensional appearance to a pattern printed on a sheet surface.

2. Description of the Related Art

A typical decorative sheet has a pattern such as a picture, letter or mark merely printed on a base sheet and is therefore lacking in a three-dimensional appearance or depth of the pattern. Various attempts have been made to give an enhanced three-dimensional appearance to a pattern. As this kind of decorative sheet, for example, a decorative sheet disclosed in Japanese Patent Laid-Open Publication No. HEI-6-182937 is known.

The known decorative sheet has a structure in which a printed pattern is formed on a transparent resin layer including squamiform particles. Thus, in the decorative sheet, the addition of the transparent squamiform particles to the transparent resin results in different looks of a distance from the surface of the transparent resin layer to the printed pattern according to position, thereby supplying perspective and a three-dimensional appearance to the pattern.

The aforementioned conventional decorative sheet supplies perspective with a large number of squamiform particles in the transparent resin layer with a limited thickness and therefore has a limit in largely increasing a three-dimensional appearance. In order to provide an improved three-dimensional appearance, it is required to increase the thickness of the transparent resin layer. However, the thicker the transparent resin layer is, the thicker the decorative sheet as a whole is, resulting in an inferior appearance. Further, when it is a flexible decorative sheet, increase in thickness of the transparent resin layer reduces flexibility of the sheet and thus is an inexpedient measure.

SUMMARY OF THE INVENTION

The present invention has been attained in view of the above problems. It is accordingly an object of providing a decorative sheet in which a three-dimensional appearance of a pattern is further improved without increasing the thickness of the decorative sheet.

According to an aspect of the present invention, there is provided a decorative sheet comprising a reflective layer for reflecting light, a transparent layer formed on the reflective layer, a light shielding layer formed on the transparent layer, a pattern layer containing a letter, figure, mark or the like interposed between the light shielding layer and the reflective layer, and a plurality of through holes provided in the light shielding layer for passing an incident light beam toward the reflective layer or an emission light beam which leads out a pattern image reflected in the reflective layer.

Thus, in the present invention, a pattern of the pattern layer interposed between the reflective layer and the light shielding layer is reflected in the reflective layer, and the reflected image of the pattern can be seen through the through holes from the light shielding layer side. Since what is seen is an image of a pattern reflected in the reflective layer, a path in which an incident light beam strikes the pattern layer, and via the reflective layer, reaches the through hole as an emission light beam is longer. The longer length of the path makes it possible to see the pattern as an image with an enhanced three-dimensional appearance, thereby eliminating the need for increasing the thickness of the decorative sheet.

Desirably, the pattern layer is provided on the rear surface of the light shielding layer.

It is preferred that each part of the pattern layer interposed between the reflective layer and the light shielding layer be interposed in an arbitrary different position because the length of an optical path in which an incident light beam strikes each part of the pattern, and via the reflective layer, reaches the through hole as an emission light beam is different from each other, resulting in a further enhanced three-dimensional appearance.

In the present invention, projections protruding toward the transparent layer and constituting a pattern can be integrally formed on the rear surface of the light shielding layer, and further projections protruding toward the transparent layer can be integrally formed on the internal surface of the reflective layer.

A protective layer made of light transmissive resin or glass is formed on the light shielding layer for protecting the decorative surface of the decorative sheet from damage. In this case, a refractive index of the protective layer is substantially equal to that of the transparent layer.

If a supplementary transparent layer having a light refractive index different from that of the transparent layer is formed on the light shielding layer, refraction of an emission light beam is changed. This makes it possible to set the opening width of the through holes arbitrary.

If a lining layer for reflecting light is interposed between the light shielding layer and the pattern layer, the contrast between the light shielding layer and the pattern layer is preferably clarified.

BRIEF DESCRIPTION OF THE DRAWINGS

Several preferred embodiments of the present invention will be described in more detail below, by way of example only, with reference to the accompanying drawings, in which.

DETAILED DESCRIPTION OF THE PREFERRED EMBODIMENTS

The following description is merely exemplary in nature and is in no way intended to limit the invention, its application or uses.

Figure 1:
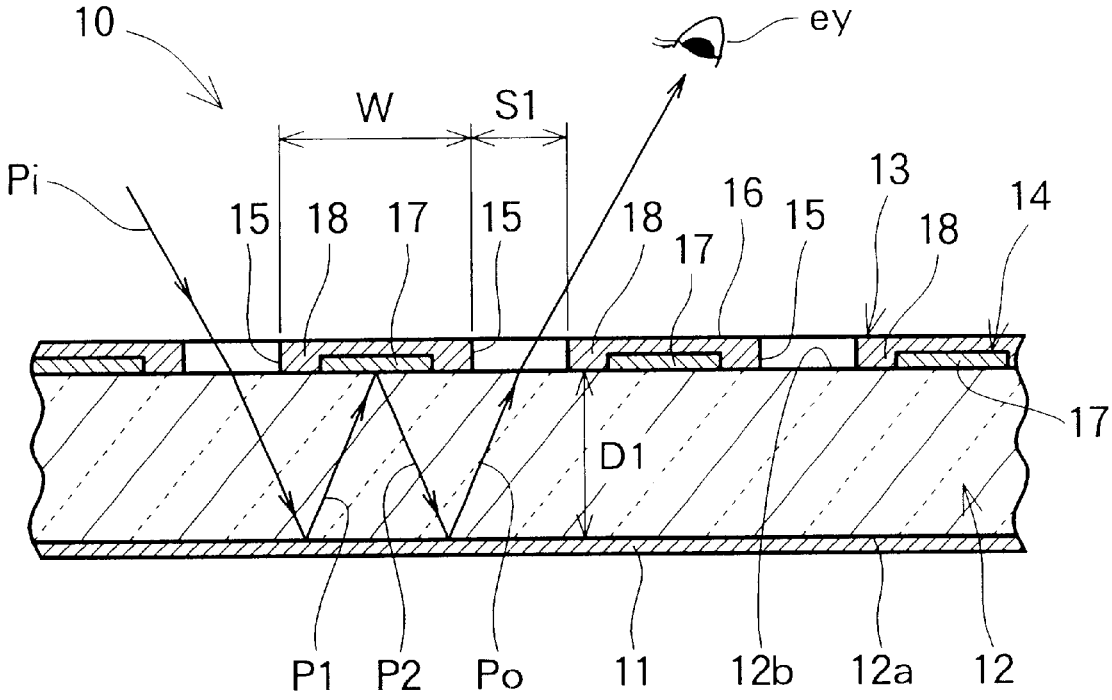
FIG. 1 is an enlarged sectional view of a decorative sheet according to a first embodiment of the present invention.
Figure 2:
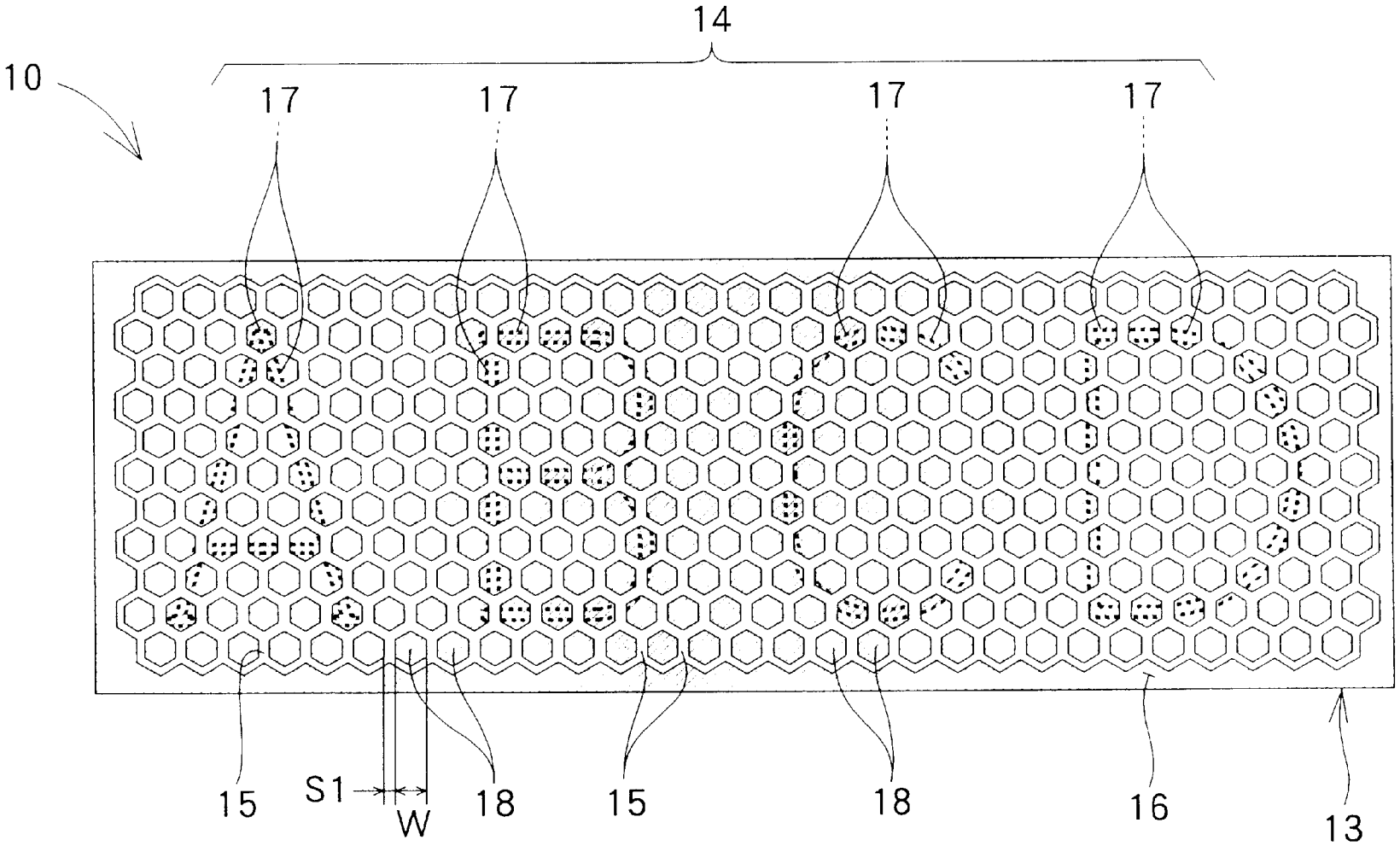
FIG. 2 is a plan view of the decorative sheet as shown in FIG. 1.
Figure 3:
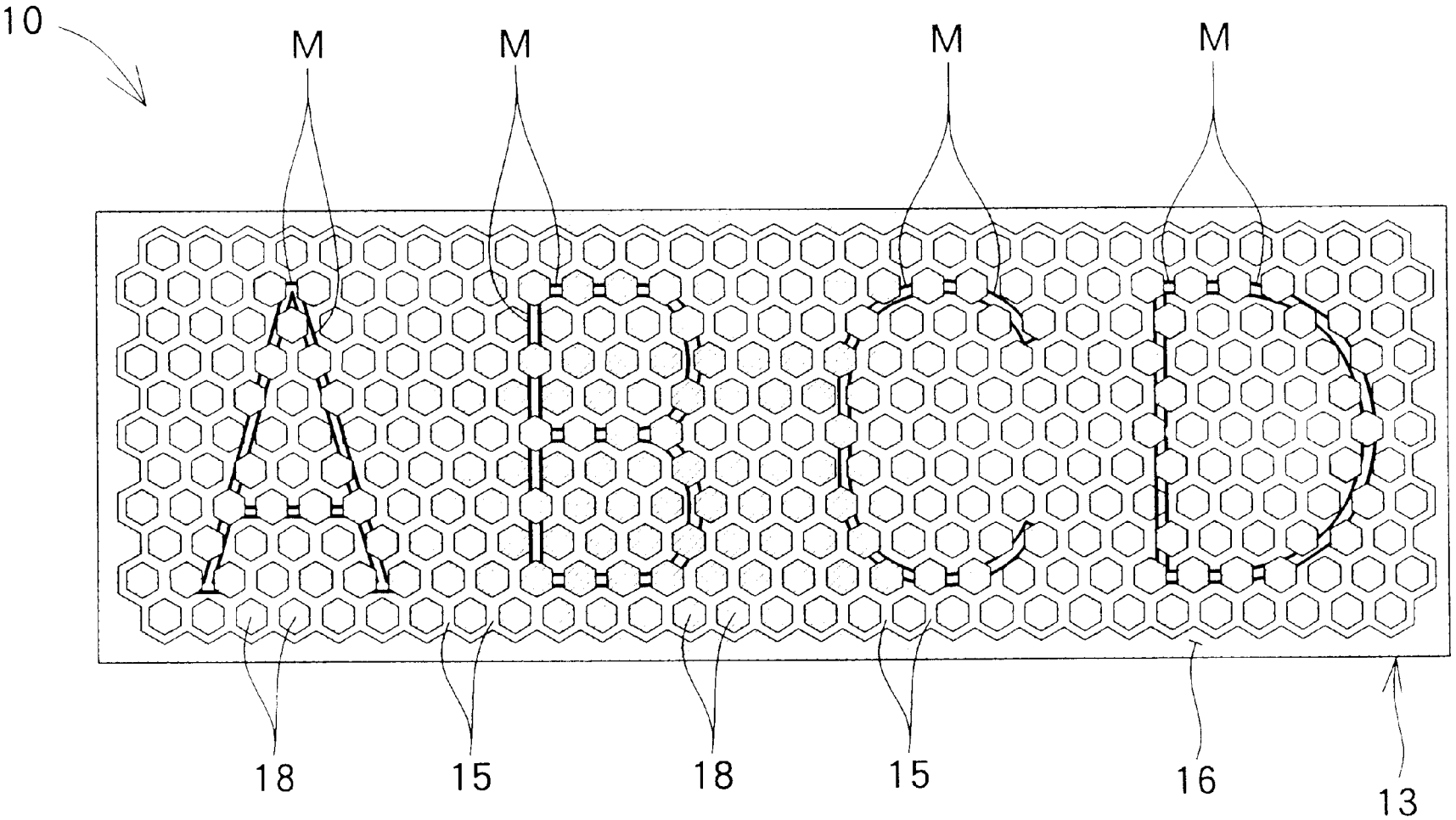
FIG. 3 is a functional diagram of the decorative sheet as shown in FIG. 2.

FIG. 1 to FIG. 3 show a decorative sheet according to a first embodiment of the present invention.

In FIG. 1, a decorative sheet 10 comprises a reflective layer 11 for reflecting light, a transparent layer 12 formed on the reflective layer 11, a light shielding layer 13 formed on the transparent layer 12, a pattern layer 14 interposed between the light shielding layer 13 and the reflective layer 11 and a plurality of through holes 15 provided in the light shielding layer 13. The decorative sheet 10 is a relatively thin sheet into which the reflective layer 11 of the first layer, the transparent layer 12 of the second layer, the light shielding layer 13 of the third layer and the pattern layer 14 between the first and third layers are integrated, in which the light shielding layer 13 is provided with the through holes 15 and the outer surface of the light shielding layer 13 serves as a decorative surface 16, a display surface.

The transparent layer 12 transmits light, and the light shielding layer 13 does not transmit light. The pattern layer 14 contains a pattern 17 such as a predetermined letter, figure or mark, and can lie between the reflective layer 11 and the light shielding layer 13 in such a manner, for example, that it is integrally provided on the rear surface of the light shielding layer 13.

The through holes 15 pass an incident light beam Pi from the outside to the reflective layer 11 and an emission light beam Po which leads out an image of a pattern reflected in the reflective layer 11 to the outside.

More specifically, the transparent layer 12 is a light transmissive sheet made of resin or glass. Materials of the transparent layer 12 are exemplified as follows, but not limited to them:

(1) polymethyl methacrylate resin (abbreviated as PMMA) with a refractive index of about 1.49;
(2) cyclic olefin resin with a refractive index of about 1.53;
(3) styrene acrylate resin (abbreviated as AS) with a refractive index of about 1.57;
(4) polycarbonate resin (abbreviated as PC) with a refractive index of about 1.59; and
(5) polystyrene resin (abbreviated as PS) with a refractive index of about 1.59.

The reflective layer 11 is of a light-reflective color such as white, gold, silver or chrome, which is integrally provided on the rear surface 12*a* of the transparent layer 12 by an adhering process such as plating, vapor deposition, printing (e.g., plating-style printing) or coating.

The light shielding layer 13 and the pattern layer 14 are integrally provided on the top surface 12*b* of the transparent layer 12 by an adhering process such as printing. For example, the pattern layer 14 is formed on the transparent layer 12 by printing, and then the light shielding layer 13 of a dark color such as black is formed thereon by printing.

Now the function of the decorative sheet 10 with the aforementioned structure will be described.

The incident light beam Pi from the decorative surface 16 of the decorative sheet 10 (outside) to the reflective layer 11 passes through the through hole 15 and the transparent layer 12 to strike the reflective layer 11. The light beam reflected off the reflective layer 11 passes through the transparent layer 12 as a first reflected light beam P1 to strike the pattern 17 of the pattern layer 14. The light beam which stroke the pattern 17 passes through the transparent layer 12 again as a second reflected light beam P2 toward the reflective layer 11 to reflect an image of the pattern in the reflective layer 11. The light beam reflected again off the reflective layer 11 passes through the transparent layer 12 as the emission light beam Po which leads out the image of the pattern reflected in the reflective layer 11, and passes through the throughhole 15 to go out to the decorative surface 16 side (outside).

Thus the pattern 17 of the pattern layer 14 is reflected in the reflective layer 11, and the reflected image of the pattern can be seen through the through holes 15 from the light shielding layer 13 side, that is, from the side of the decorative surface 16 of the decorative sheet 10 by an eye "ey."

Since what is seen is the image of the pattern reflected in the reflective layer 11, there is provided a relatively long optical path in which the incident light beam Pi strikes the pattern layer 14 and via the reflective layer 11, reaches the through hole 15 as the emission light beam Po. In other words, the length of the optical path corresponds to a combined distance of the distance from the pattern layer 14 to the reflective layer 11 and the distance from the reflective layer 11 to the through hole 15, that is, a distance equal to twice the thickness D1 of the transparent layer 12. As a result, the depth of the sheet is increased and the pattern 17 can be seen as a three-dimensional image. Accordingly, a three-dimensional appearance of the pattern 17 can be further improved without increasing the thickness of the decorative sheet 10.

Further, from the fact that the pattern 17 of the pattern layer 14 provided on the rear surface of the light shielding layer 13 is reflected in the reflective layer 11, and the reflected image of the pattern is seen through the through holes 15 from the decorative surface 16 side by the eye "ey," the reflected image of the pattern may partly be seen or may not be seen, depending on a viewing angle.

Furthermore, it is possible to cover the outer surface of the light shielding layer 13 (decorative layer 16) with another pattern layer not shown in the figure, thereby to see a combined pattern of the pattern of this pattern layer and the image of the pattern reflected in the reflective layer 11.

FIG. 2 is a plan view of a decorative sheet according to the present invention, showing the decorative sheet 10 from the decorative surface 16 side.

This figure shows that a plurality of regular hexagon light shielding parts 18 with a prescribed width W (as shown by hatching in the figure) are in a stagger arrangement with a prescribed pitch in the light shielding layer 13, thereby to form the through holes 15 between the light shielding parts 18 adjacent to each other. The through holes 15 are thin continuous holes with a prescribed opening width S1.

The light shielding layer 13 has the rear surface of the right hexagonal light shielding parts 18 integrally provided with a predetermined pattern 17, for example, the letters "A," "B," "C" and "D" as shown by dashed lines in the figure. Such a pattern 17 cannot be seen directly from the decorative surface 16 side.

FIG. 3 is a functional diagram of a decorative sheet according to the present invention, exemplifying the state in which an image M of the pattern reflected in the reflective layer 11 (See FIG. 1) is seen through the through holes 15 from the decorative surface 16 side. For example, the mosaicked letters "A," "B," "C" and "D" are seen through the through holes 15. The image M of the pattern has different looks, depending on a viewing angle.

Now other several embodiments of the decorative sheet 10 will be described with reference to FIG. 4 to FIG. 11. Elements similar to those of the decorative sheet in the first embodiment as shown in FIG. 1 to FIG. 3 are given the same marks, and are not herein described in detail.

Figure 4:
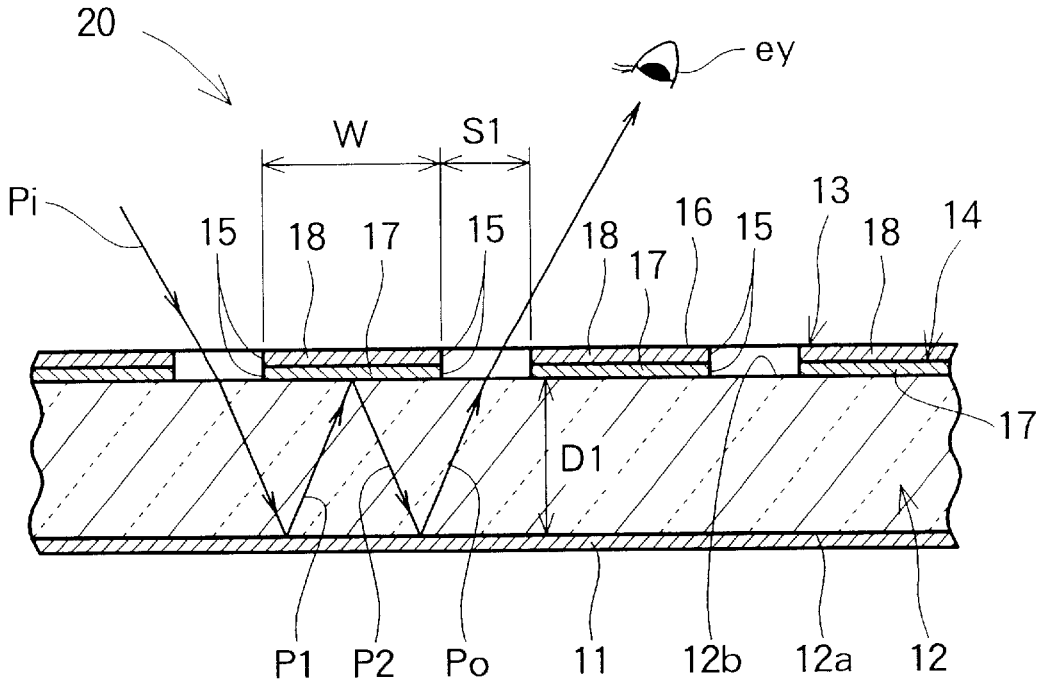
FIG. 4 is a sectional view of a decorative sheet according to a second embodiment of the present invention.

FIG. 4 shows a sectional view of a decorative sheet according to a second embodiment of the present invention.

A decorative sheet 20 of the second embodiment has each of a reflective layer 11, a transparent layer 12, a pattern layer 14 and a light shielding layer 13 as a sheet with a prescribed thickness, in which the transparent layer 12, the pattern layer 14 and the light shielding layer 13 are integrally superimposed in this order on the reflective layer 11. In this embodiment, a plurality of through holes 15 are formed in both the pattern layer 14 and the light shielding layer 13. It is also possible to prepare one of the reflective layer 11, transparent layer 12, pattern layer 14 and light shielding layer 13 as a sheet on which the others are integrally provided by an adhering process such as printing. The decorative sheet 20 of the second embodiment also has effects similar to those of the decorative sheet 10 of the first embodiment as shown in FIG. 1 to FIG.3.

Figure 5:
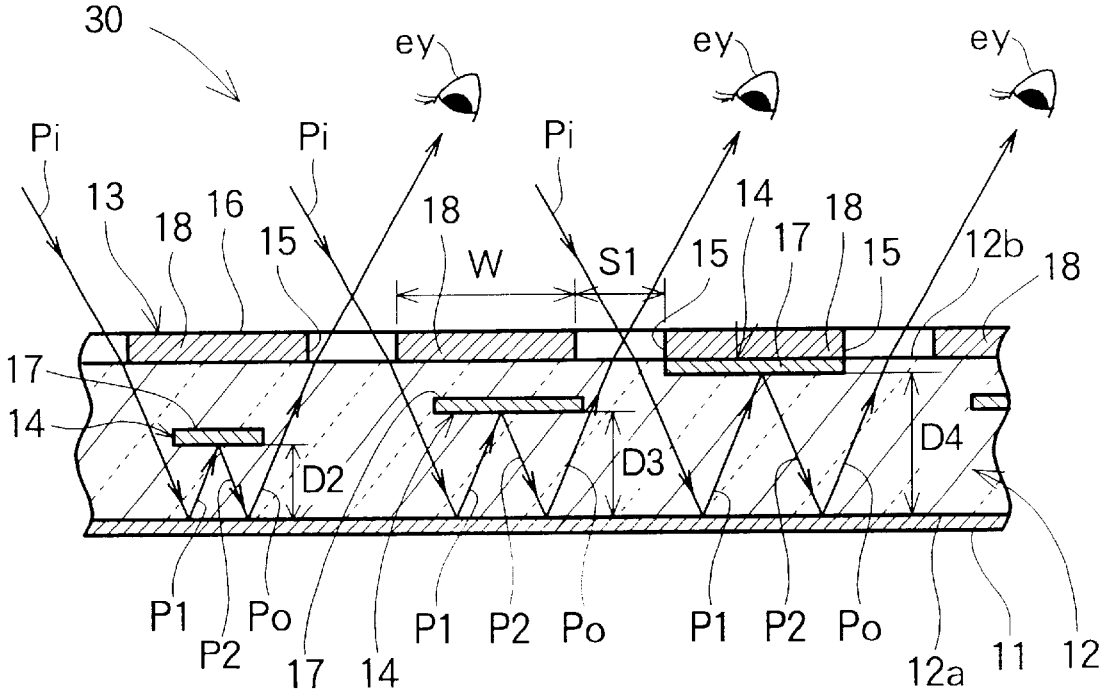
FIG. 5 is a sectional view of a decorative sheet according to a third embodiment of the present invention.

FIG. 5 shows a sectional view of a decorative sheet according to a third embodiment of the present invention.

A decorative sheet 30 of the third embodiment has each part of a pattern 17 of a pattern layer 14 interposed at an arbitrary level from a reflective layer 11 between the reflective layer 11 and a light shielding layer 13. For example, a first part of the pattern 17 on the left of the figure is disposed in a position at a distance D2 from the reflective layer 11, a second part of the pattern 17 in the middle of the figure is disposed in a position at a distance D3, and a third part of the pattern 17 on the right of the figure is disposed in a position at a distance D4. The distance D2 is the shortest and the distance D4 is the longest (D2<D3<D4).

The length of an optical path in which an incident light beam Pi strikes each part of the pattern 17 and then via the reflective layer 11, reaches a through hole 15 as an emission light beam Po is different from each other. Accordingly, the decorative sheet 30 of the third embodiment can give a further improved three-dimensional appearance to the pattern 17 than the decorative sheet 10 as shown in FIG. 1, increasing design freedom. The pattern 17 of this embodiment is integrally formed in a transparent layer 12.

The decorative sheet 30 of the third embodiment also has effects similar to those of the decorative sheet 10 of the first embodiment as shown in FIG. 1 to FIG. 3 as well as the aforementioned effects.

Figure 6:
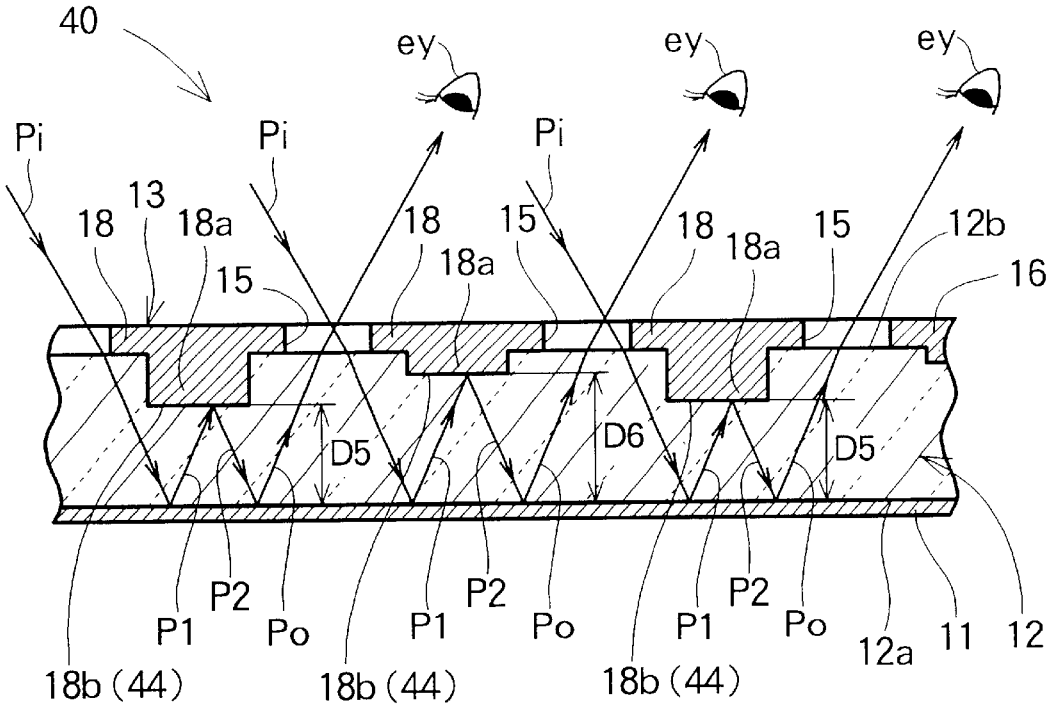
FIG. 6 is a sectional view of a decorative sheet according to a fourth embodiment of the present invention.

FIG. 6 shows a sectional view of a decorative sheet according to a fourth embodiment of the present invention.

A decorative sheet 40 of the fourth embodiment has a light shielding layer 13 formed to have projections and depressions on its rear surface, thereby also serving as a pattern layer having a pattern. More specifically, a projection 18*a* protruding toward a transparent layer 12 is formed on the rear surface of a light shielding part 18 in the light shielding layer 13, and a projection surface (top surface) 18*b* of the projection 18*a* is made to be a part of a pattern of a pattern layer 44. In this embodiment, the pattern layer 44 is integrally resin-molded with the light shielding layer 13, and a color of the projection surface 18*b*, that is, a color of each part of the pattern is the same single color as that of the light shielding layer 13. The projection surfaces 18*b* as a whole as the pattern is reflected in a reflective layer 11 as an image of the pattern. That is, the image of the projection surfaces 18*b* is reflected in the reflective layer as the image of the pattern. Accordingly, the reflection (the image of the pattern) in the reflective layer 11 can be seen through the through holes 15 from the decorative surface 16 side.

For example, a first projection surface 18*b* on the left of the figure and a second projection surface 18*b* on the right of the figure are disposed in a position at a distance D5 from the reflective layer 11 and a third projection surface 18*b* in the middle of the figure is disposed in a position at a distance D6. The distance D5 is shorter than the distance D6 (D5<D6). As a result, the length of an optical path in which an incident light beam Pi strikes each projection surface (pattern) 18*b* and via the reflective layer 11, reaches a through hole 15 as an emission light beam Po is different from each other. Accordingly, the decorative sheet 40 of the fourth embodiment gives a further improved three-dimensional appearance to the pattern layer 44 than the decorative sheet 10 as shown in FIG. 1, increasing design freedom.

The decorative sheet 40 of the fourth embodiment also has effects similar to those of the decorative sheet 10 of the first embodiment as shown in FIG. 1 to FIG. 3 as well as the aforementioned effects.

Figure 7:
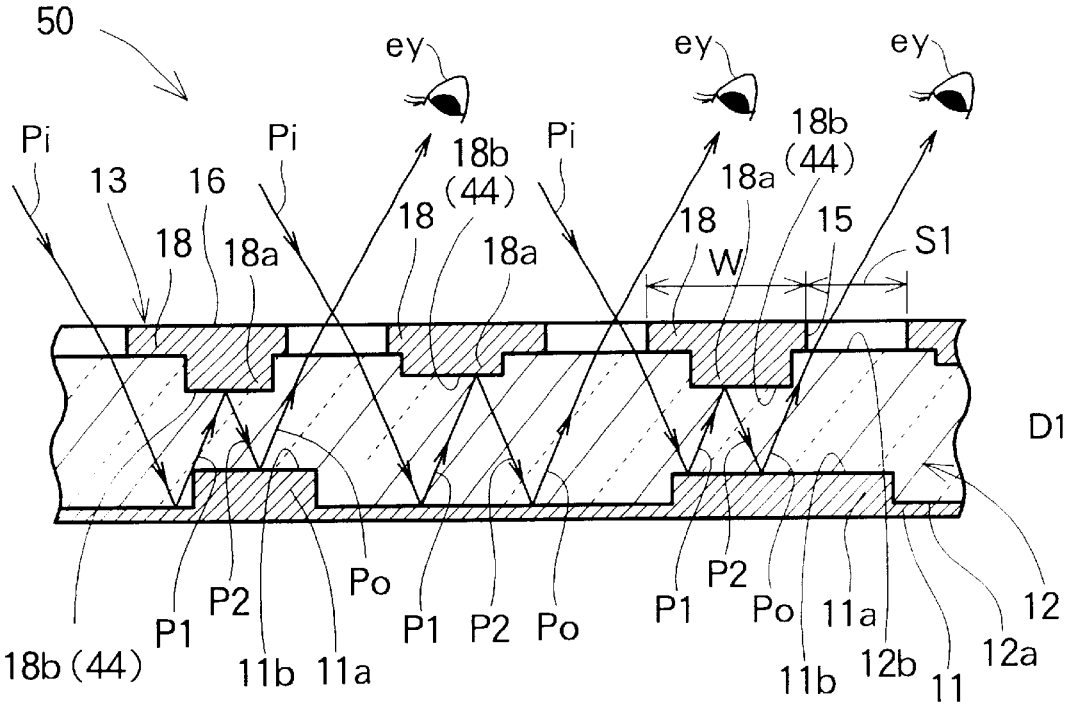
FIG. 7 is a sectional view of a decorative sheet according to a fifth embodiment of the present invention.

FIG. 7 shows a sectional view of a decorative sheet according to a fifth embodiment of the present invention.

A decorative sheet 50 of the fifth embodiment is a variant of the decorative sheet 40 of the fourth embodiment as shown in FIG. 6, in which the internal surface of a reflective layer 11 is formed to have projections and depressions. More specifically, a projection 11*a* protruding toward a transparent layer 12 is formed on the internal surface of the reflective layer 11, and a projection surface (top surface) 11*b* of the projection 11*a* also serves as a reflective surface for reflecting light. As a result, there are provided further variations in distance from the internal surface and the projection surface (reflective surface) 11*b* of the reflective layer 11 to a projection surface 18*b* formed on the rear surface of a light shielding layer 13, which fact results in a further improved three-dimensional appearance of a pattern layer 44 than in the decorative sheet 40 of the fourth embodiment as shown in FIG. 6, further increasing design freedom.

The decorative sheet 50 of the fifth embodiment also has effects similar to those of the decorative sheet 10 of the first embodiment as shown in FIG. 1 to FIG. 3 as well as the aforementioned effects.

Figure 8:
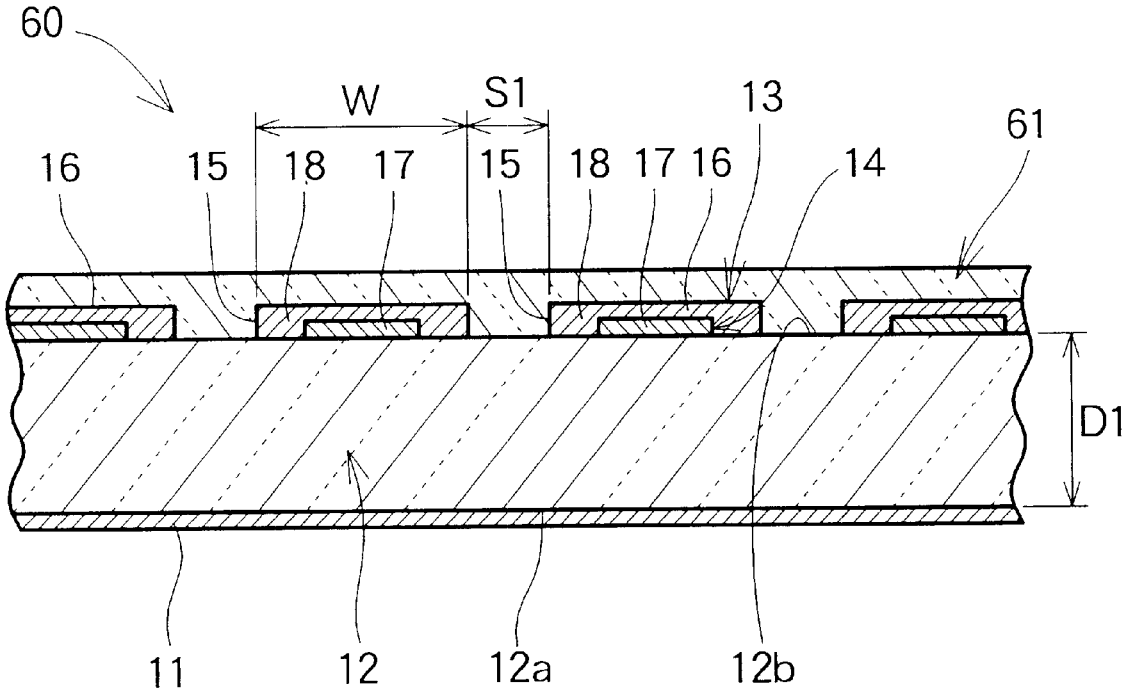
FIG. 8 is a sectional view of a decorative sheet according to a sixth embodiment of the present invention.

FIG. 8 shows a sectional view of a decorative sheet according to a sixth embodiment of the present invention.

A decorative sheet 60 of the sixth embodiment is a variant of the decorative sheet 10 as shown in FIG. 1, and has a protective layer 61 covering the surface of a light shielding layer 13, that is, a decorative surface 16. The protective layer 61 is made of light transmissive resin or glass. The protective layer 61 has a refractive index almost identical to that of a transparent layer 12. The protective layer 61 protects the decorative surface 16 from damage.

The decorative sheet 60 of the sixth embodiment also has effects similar to those of the decorative sheet 10 of the first embodiment as shown in FIG. 1 to FIG. 3 as well as the aforementioned effects.

Figure 9A:
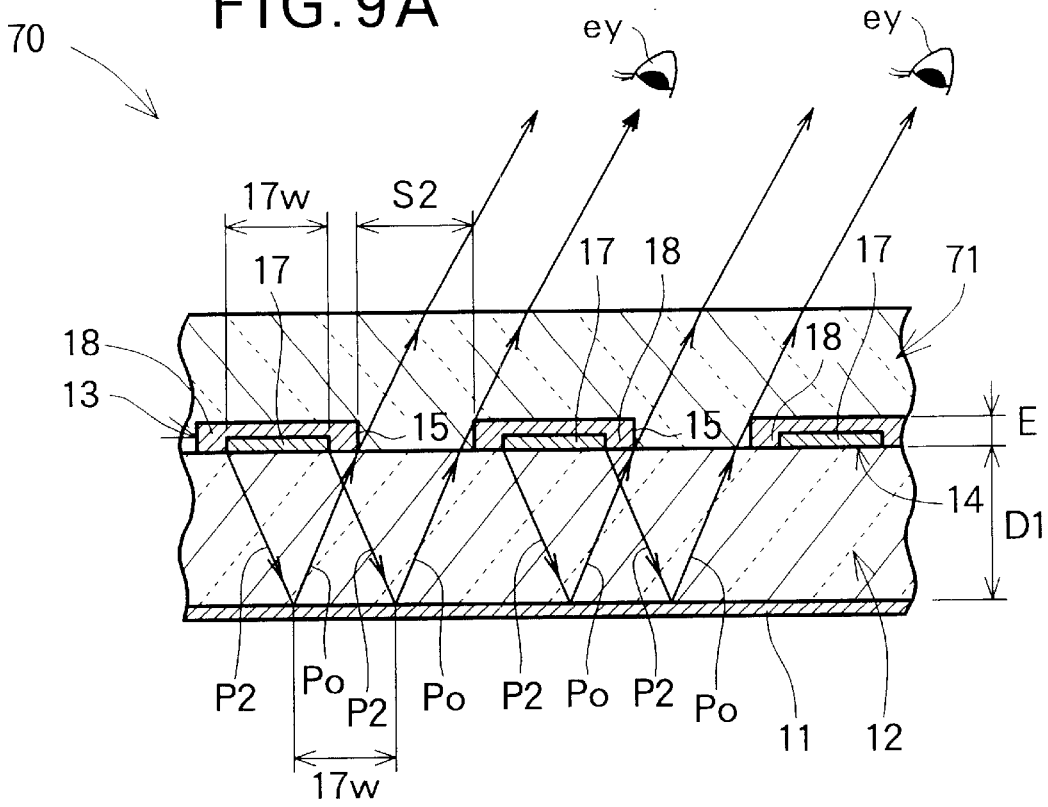
FIG. 9A and FIG. 9B are sectional views of a decorative sheet according to a seventh embodiment of the present invention and a variant thereof.
Figure 9B:
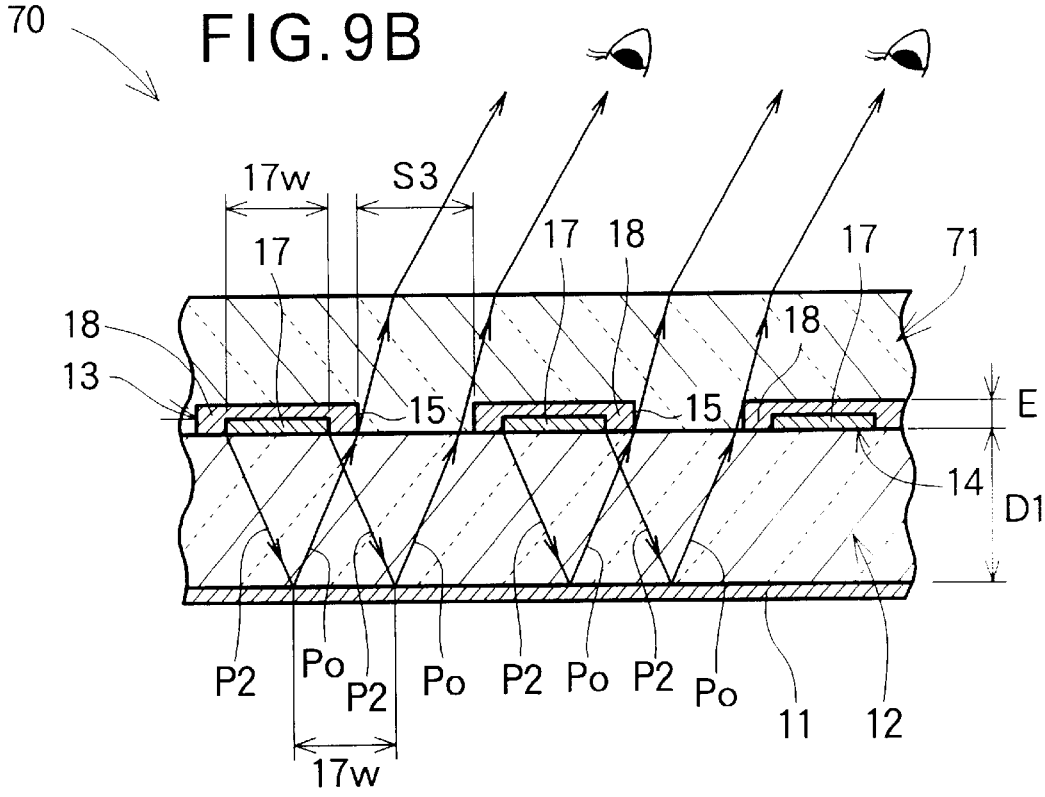

FIG. 9A and FIG. 9B show sectional views of a decorative sheet according to a seventh embodiment of the present invention.

A decorative sheet 70 of the seventh embodiment is a variant of the decorative sheet 60 of the sixth embodiment as shown in FIG. 8, and has a supplementary transparent layer 71 with a prescribed thickness which covers the surface of a light shielding layer 13, that is, a decorative surface 16. The seventh embodiment is characterized in that the refractive index of the supplementary transparent layer 71 is different from that of a transparent layer 12. The supplementary transparent layer 71 is made of light transmissive resin or glass.

More specifically, in the decorative sheet 70 as shown in FIG. 9A, the refractive index of the supplementary transparent layer 71 is set smaller than that of the transparent layer 12. For example, cyclic olefin resin (with a refractive index of about 1.53) is used as a material for the transparent layer 12 and PMMA (with a refractive index of about 1.49) as a material for the supplementary transparent layer 71. In FIG. 9A, the opening width of a through hole 15 is set at S2 in order for an emission light beam Po to lead out an entire image of a part of a pattern 17 with a width 17*w* reflected in a reflective layer 11 outside through the through hole 15 with a depth E. Since the refractive index of the supplementary transparent layer 71 is smaller, the opening width S2 is relatively larger.

On the other hand, in a decorative sheet 70 as shown in FIG. 9B, the refractive index of a supplementary transparent layer 71 is set larger than that of a transparent layer 12. For example, cyclic olefin resin (with a refractive index of about 1.53) is used as a material for the transparent layer 12 and PS (with a refractive index of about 1.59) is used as a material for the supplementary transparent layer 71. In FIG. 9B, the opening width of a through hole 15 is set at S3 in order for an emission light beam Po to lead out an entire image of a part of a pattern 17 with a width 17*w* reflected in a reflective layer 11 outside through the through hole 15 with a depth E. Since the refractive index of the supplementary transparent layer 71 is larger, the opening width S3 can be smaller than S2 as shown in FIG. 9A.

Thus, a difference in refractive index of the supplementary transparent layer 71 from the transparent layer 12 determines the opening width of the through hole 15 as S2 or S3 appropriately, thereby increasing design freedom of the decorative sheet 70.

The decorative sheet 70 of the seventh embodiment also has effects similar to those of the decorative sheet 10 of the first embodiment as shown in FIG. 1 to FIG. 3 as well as the aforementioned effects.

Figure 10:
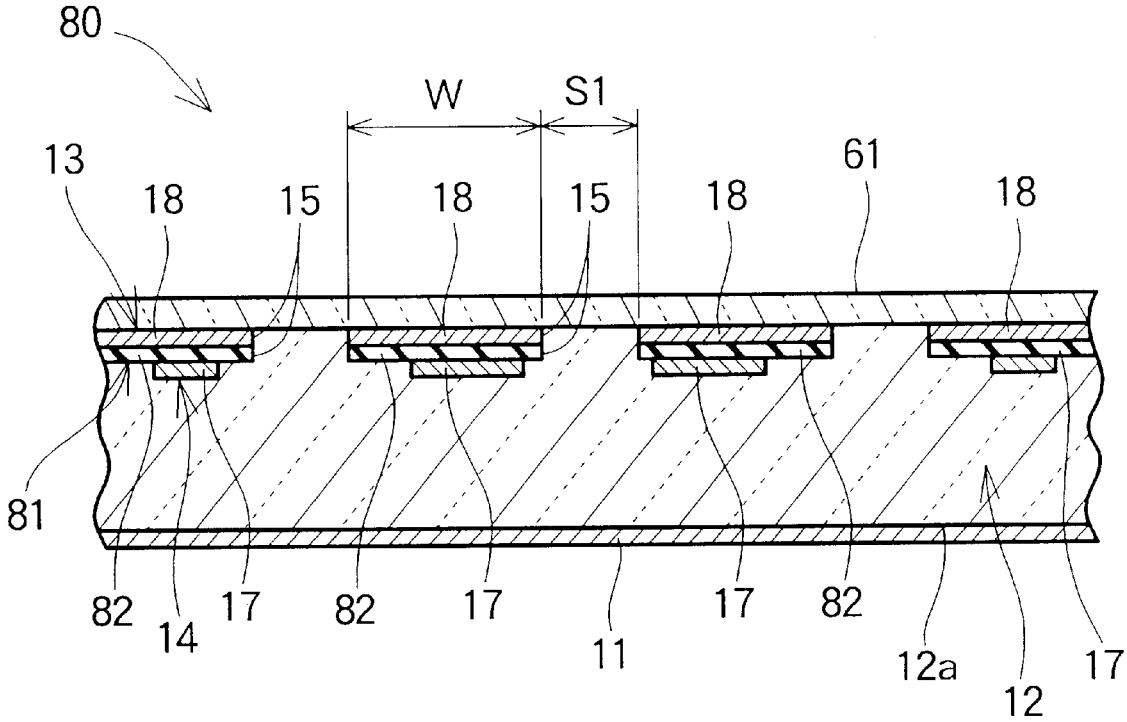
FIG. 10 is a sectional view of a decorative sheet according to an eighth embodiment of the present invention.

FIG. 10 shows a sectional view of a decorative sheet according to a eighth embodiment of the present invention.

A decorative sheet 80 of the eighth embodiment has a lining layer 81 of a light-reflective color which is interposed between a light shielding layer 13 and a pattern layer 14. More specifically, the lining layer 81 provides a lining reflective part 82 of a light-reflective color such as white, gold, silver or chrome on the rear surface of a light shielding part 18.

When the pattern layer 14 of a dark color such as black or red is combined with the light shielding layer 13 of a dark color such as black, it may generally be difficult to clarify the contrast between them. In the decorative sheet 80, the contrast of a pattern 17 of the pattern layer 14 to the lining layer 81 of a light-reflective color is made clear. Thus, a pattern image reflected in a reflective layer 11 can be seen more clearly.

The decorative sheet 80 of the eighth embodiment also has effects similar to those of the decorative sheet 10 of the first embodiment as shown in FIG. 1 to FIG. 3 as well as the aforementioned effects.

FIG. 1A to FIG. 11C show variants of through holes 15 formed in a light shielding layer 13.

Figure 11A:
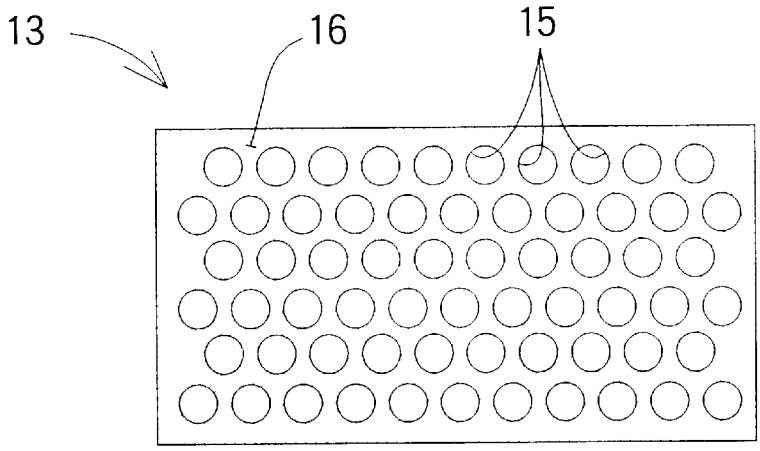
FIG. 11A, FIG. 11B and FIG. 11C are diagrams showing variants of a light shielding layer according to the present invention.
Figure 11B:
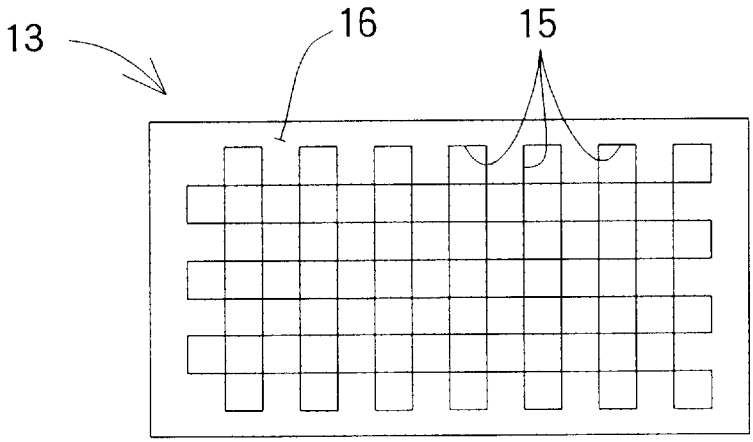
Figure 11C:
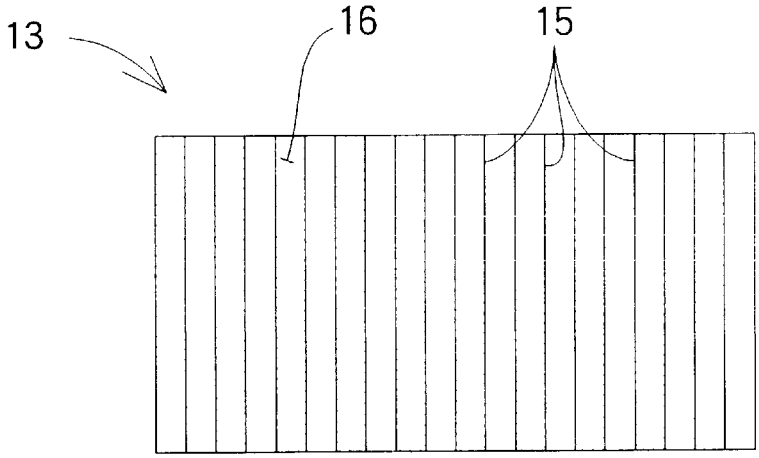

In a light shielding layer 13 as shown in FIG. 11A, a plurality of round through holes 15 are formed in a staggered arrangement with a prescribed pitch. In a light shielding layer 13 as shown in FIG. 11B, a plurality of square through holes are formed in a staggered arrangement with a prescribed pitch. In a light shielding layer 13 as shown in FIG. 11C, a plurality of thin through holes 15 are formed with a prescribed pitch.

Thus in the light shielding layer 13, through holes 15 in various kinds of round shapes or slit shapes can be provided in an arrangement with an arbitrary pitch. Further, the pitch of the through holes can be irregular other than regular.

Figure 12A:
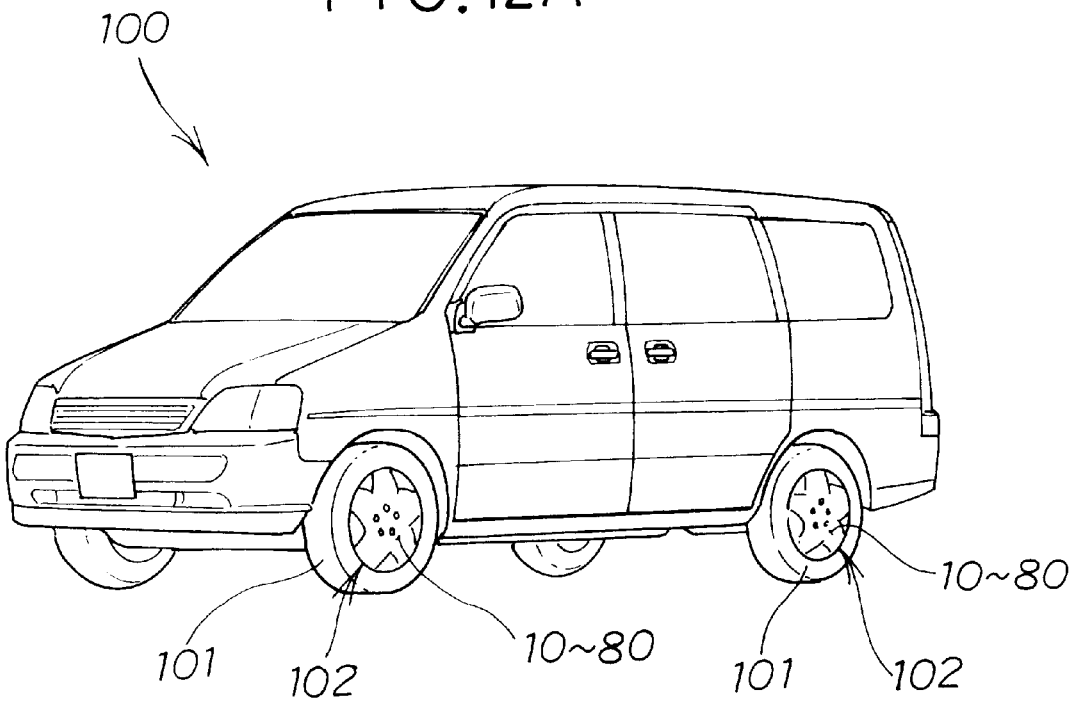
FIG. 12A and FIG. 12B are diagrams showing use of a decorative sheet according to the present invention, exemplifying its application to a vehicle.
Figure 12B:
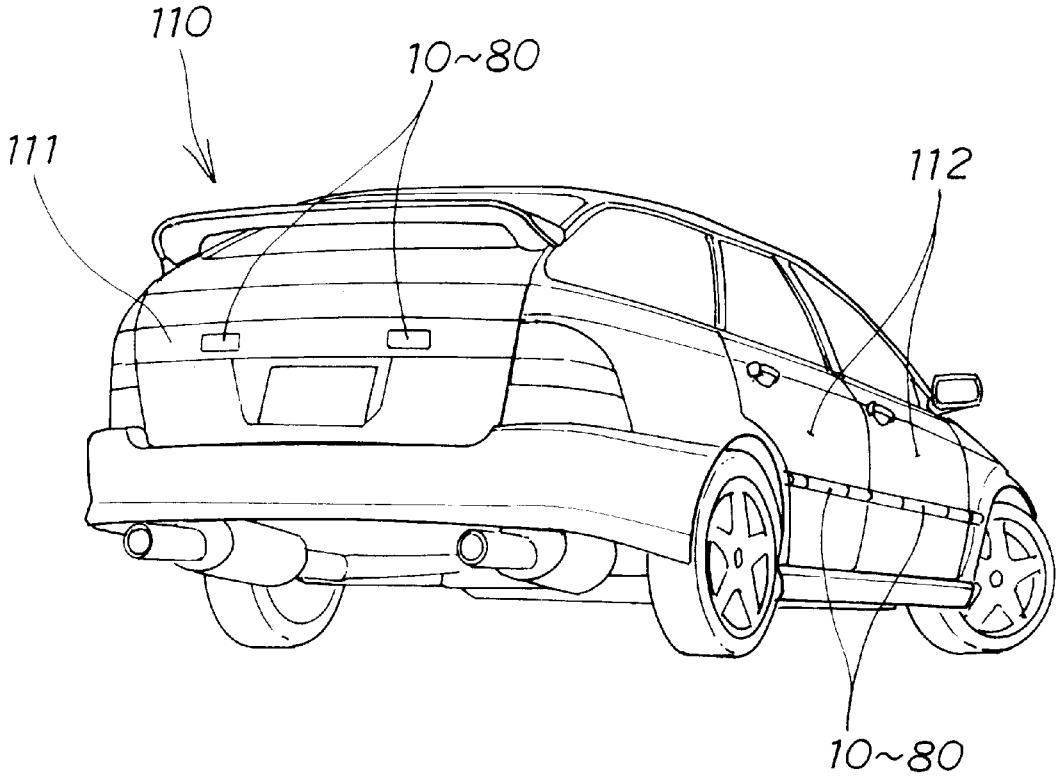

FIG. 12A and FIG. 12B show examples of use of a decorative sheet according to the present invention.

The decorative sheets 10 to 80 as shown in FIG. 1 to FIG. 10 can be attached for use to various objects such as a vehicle, house or display. The decorative sheets 10 to 80 can be affixed to, for example, wheel trims 102 of wheels 101 of an automobile 100 as shown in FIG. 12A or affixed to a back body 111 or doors 112 of an automobile 110 as shown in FIG. 12B, thereby to improve commodity value of the automobiles 100 and 110.

In each embodiment of the present invention and its variants, two or more characteristic elements of the decorative sheets 10 to 80 can be combined appropriately. Further, the decorative sheets 10 to 80 can be flexible sheets.

The shape, size and material of the reflective layer 11, transparent layer 12, light shielding layer 13, pattern layer 14, protective layer 61, supplementary transparent layer 71 and lining layer 81 are arbitrary.

Obviously, various minor changes and modifications of the present invention are possible in the light of the above teaching. It is therefore to be understood that within the scope of the appended claims, the invention may be practices otherwise than as specifically described.

What is claimed is:

1. A decorative sheet comprising:

a reflective layer for reflecting light;

a transparent layer formed on said reflective layer;

a light shielding layer formed on said transparent layer;

a pattern layer containing at least one of a letter, figure, and mark interposed between said light shielding layer and said reflective layer; and a plurality of through holes provided in said light shielding layer for passing an incident light beam toward said reflective layer or an emission light beam which leads out a pattern image reflected in said reflective layer.

2. A decorative sheet as set forth in claim 1, wherein said pattern layer is provided on the rear surface of said light shielding layer.

3. A decorative sheet as set forth in claim 1, wherein each part of said pattern layer interposed between said reflective layer and said light shielding layer is interposed in a different arbitrary position.

4. A decorative sheet as set forth in claim 1, wherein a projection protruding toward said transparent layer to constitute a pattern is integrally formed on the rear surface of said light shielding layer.

5. A decorative sheet as set forth in claim 4, wherein the projection protruding toward said transparent layer is integrally formed on the internal surface of said reflective layer.

6. A decorative sheet as set forth in claim 1, wherein a protective layer made of light transmissive resin or glass is formed on said light shielding layer.

7. A decorative sheet as set forth in claim 1, wherein a supplementary transparent layer having a different light refractive index from that of said transparent layer is formed on said light shielding layer.

8. A decorative sheet as set forth in claim 1, wherein a lining layer for reflecting light is interposed between said light shielding layer and said pattern layer.

* * * * *